United States Patent [19]

Freed

[11] Patent Number: 5,067,483

[45] Date of Patent: Nov. 26, 1991

[54] CERVICAL TRACTION DEVICE

[76] Inventor: William L. Freed, 21 Fairway La., Trumbull, Conn. 06611

[21] Appl. No.: 570,322

[22] Filed: Aug. 21, 1990

[51] Int. Cl.[5] ..... A61S 5/00

[52] U.S. Cl. ..... 128/76 R; 128/69; 128/75; 128/84 C

[58] Field of Search ..... 128/75, 76 R, 84 R, 128/84 C, 87 B, 87 R, 89 A, 845, 69

[56] References Cited

U.S. PATENT DOCUMENTS

| | | | |
|---|---|---|---|
| 3,621,839 | 11/1971 | Barthe | 128/84 R |
| 3,828,377 | 8/1974 | Fary, Sr. | 128/76 R |
| 4,114,612 | 9/1978 | Benjamin | 128/69 |
| 4,166,459 | 9/1979 | Nightingale | 128/75 |
| 4,320,749 | 3/1982 | Highley | 128/84 R |
| 4,736,736 | 4/1988 | Moers et al. | 128/75 |
| 4,760,842 | 8/1988 | Holmes | 128/69 |
| 4,832,007 | 5/1989 | Davis, Jr. et al. | 128/69 |
| 4,951,654 | 8/1990 | Gambale et al. | 128/75 |

*Primary Examiner*—Richard J. Apley
*Assistant Examiner*—Lynne A. Reichard
*Attorney, Agent, or Firm*—Fish & Richardson

[57] ABSTRACT

A portable cervical traction device for applying tractive forces to the cervical spine of a patient, having a head support means for the neck and head of the patient, including an occipital pad which has a reversed angled surface which causes increased cervical flexion when the device is in use and while ensuring contact between the back of the head and the occipital pad for comfort. The angle of the tractive force is also adjustable so as to isolate portions of the cervical spine for application of the traction. The invention further allows the patient to vary the tractive force applied through the use of an air cylinder, which is directly affixed to the head support means.

8 Claims, 2 Drawing Sheets

CERVICAL TRACTION DEVICE

FIELD OF THE INVENTION

The present invention is directed to cervical traction devices.

BACKGROUND OF THE INVENTION

Under certain circumstances or with certain injuries, nerves in the neck become inflamed and enlarged so that they impinge on the holes in the cervical portion of the spinal column through which they pass. This may also occur when the hole becomes smaller as well. This contact further irritates the nerves, causes discomfort and prolongs the healing process. As a result, cervical traction, which expands the holes, is often used to help the patient.

Cervical traction, in effect, involves stretching the neck of the patient. The stretching action temporarily opens the holes in the cervical portion of the spinal column and thus relieves pressure on the nerves. The patient's discomfort is relieved and any inflamed nerves have an opportunity to heal and return to normal size. Unfortunately, the principal behind cervical traction requires the tractive force to be maintained over prolonged periods of time, and the prior art traction devices are not suitable for such use.

Specifically, prior art devices are generally too uncomfortable for prolonged use of any type. There are several reasons for this depending on the design of the device. First, many prior art cervical traction devices employ chin straps to apply the traction. Because of the location of the chin strap, the pressure it applies also causes a condition called temporo mandibular joint dysfunction which results in a variety of painful syndromes. Other prior art traction devices use an occipital cupping mechanism which creates pressure on the greater occipital nerve and occipital artery when in use because they are impinged between the cupping mechanism and the base of the occiput. This causes significant discomfort. As a result, these prior art devices cannot be used to apply cervical traction over the extended period it is needed (e.g., while the patient is sleeping).

In addition, many of the prior art devices are very bulky so that they cannot easily be used at home by the patient, and many apply traction by means of a complex mechanical system, and as a result, the patient cannot easily vary the tension.

Accordingly, it is an object of this invention to provide a simple, portable cervical traction device which can be used for a long period of time without discomfort.

It is a further object of the invention to provide a traction device in which the traction can be easily adjusted by the patient.

It is a further objection of this invention to provide a traction device in which the angle of the tractive force can be easily varied.

SUMMARY OF THE INVENTION

The invention comprises a cervical traction device having a movable occipital pad onto which the patient's head rests when in use. The occipital pad is angled away from the patient's head so that when cervical traction is applied by moving the pad, the back of the patient's head not only remains on the pad so as to avoid any discomfort due to increased pressure on the occipital nerve or artery but also tilts the patient's head forward towards the chest thereby increasing cervical flexion which further enhances the effect of the traction.

In the preferred embodiment, the cervical traction device of the invention includes a base, a head support means and a drive means. The head support comprises a neck support system and an occipital pad. The occipital pad is angled so that it is thickest at the neck support and narrowest at its opposite end. The neck support and pad are mounted on a plate which is connected to an air cylinder. In use, the back of a patient's head is placed on the occipital pad with the patient's neck in the neck support. Cervical traction is applied when the patient pumps air though a hand-held bulb into the cylinder thereby moving it and the head support with respect to the base of the device. The reverse angle of the occipital pad assures that the head is always kept on the pad during this movement and thereafter while at the same time it causes the neck to flex forward which increases the effect of the traction in opening the nerve holes in the cervical portion of the spine. In any event, the patient controls the force applied and can variably release the force by opening a valve connected with the bulb thereby depressurizing the cylinder.

In addition, in the preferred embodiment, the angle of the entire head support can be varied so as to allow the tractive force to operate on certain portions of the neck. Also, the device is small, compact and portable and does not require complex mechanisms to apply the tractive force.

BRIEF DESCRIPTION OF THE DRAWINGS

We turn now to a detailed description of the preferred embodiment, after first briefly describing the drawings.

DETAILED DESCRIPTION OF THE ILLUSTRATED EMBODIMENTS

Figure 1:
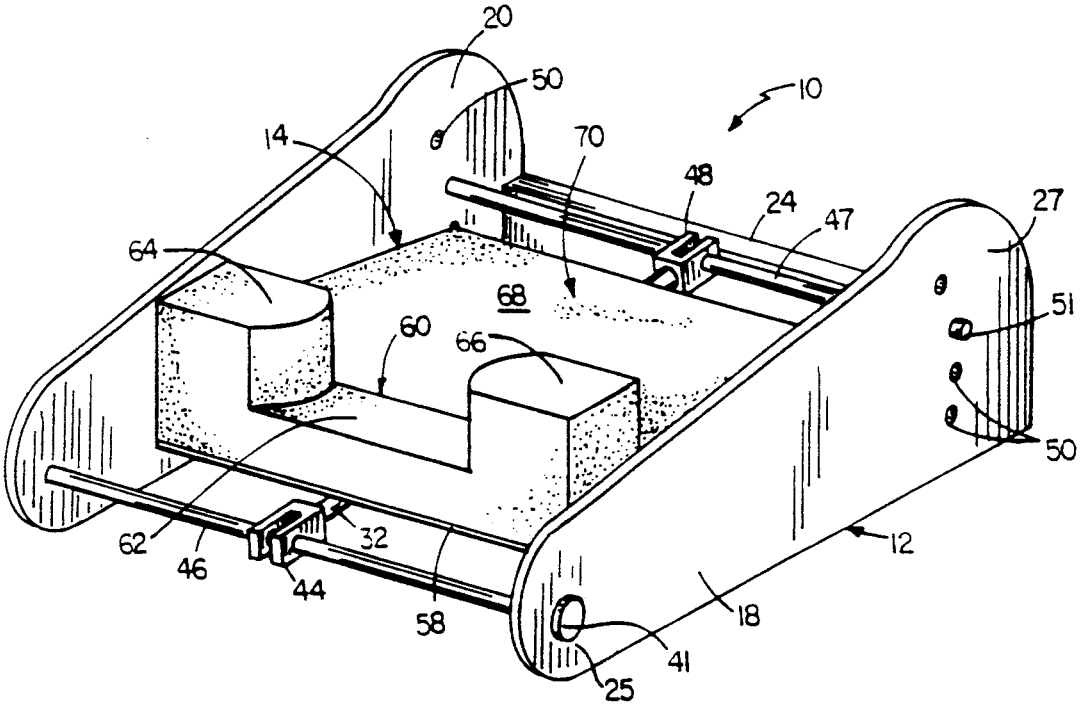
FIG. 1 is a perspective view of the portable traction apparatus of this invention.
Figure 2:
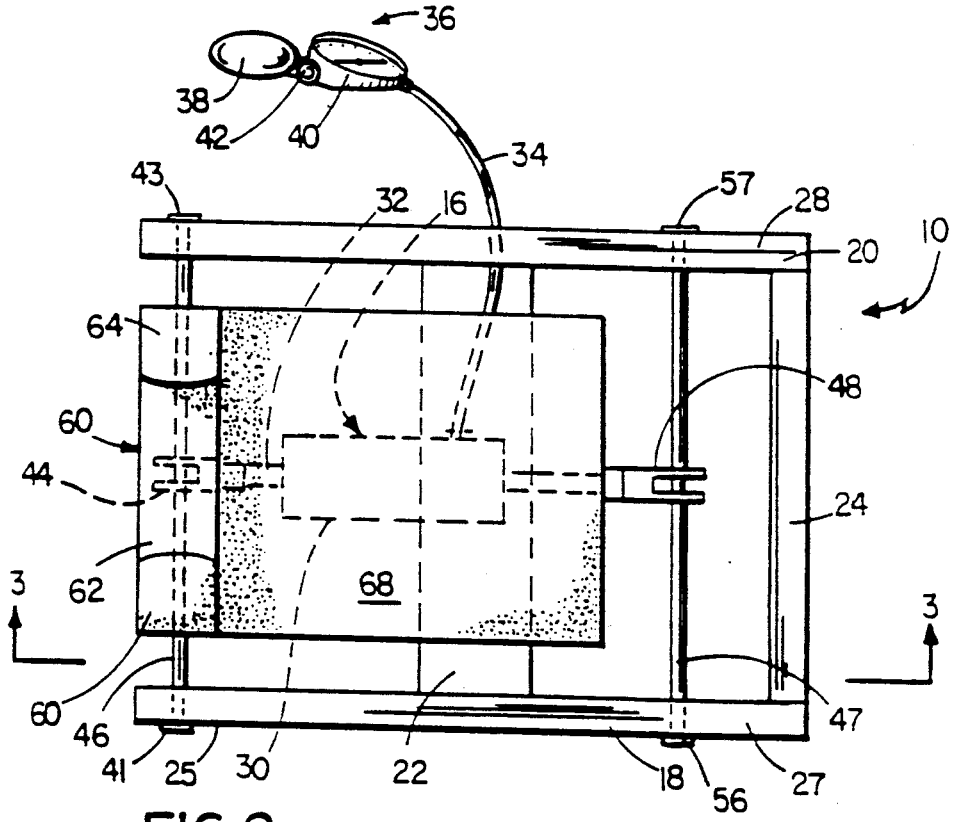
FIG. 2 is a top view of the invention.
Figure 3:
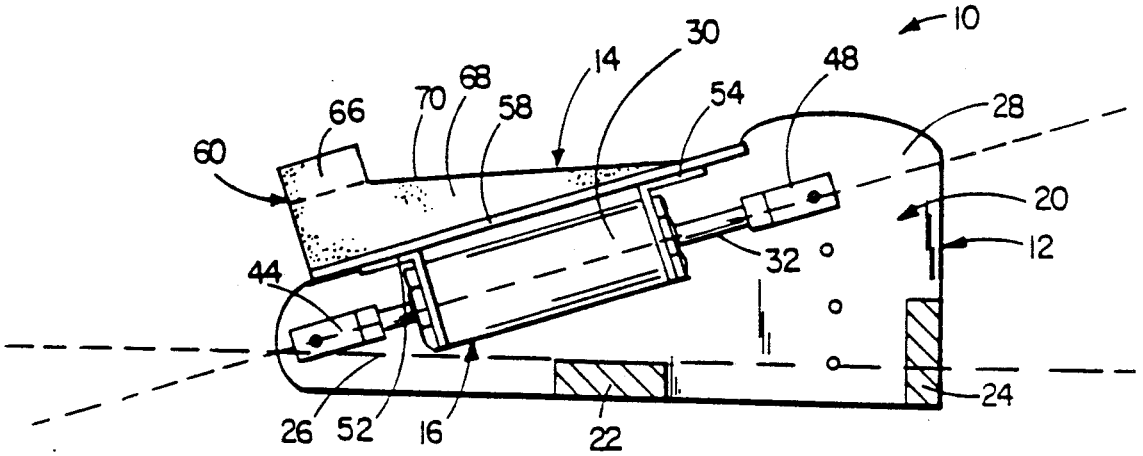
FIG. 3 is a cross-section view of the invention taken along lines 3—3 of FIG. 2.

Referring to FIGS. 1–3, a cervical traction apparatus of this invention is shown at 10. The traction apparatus 10 generally comprises a base 12, a movable head support section 14 and a drive means 16, best shown in FIGS. 2 and 3, for moving the support section 14 with respect to the base 12.

The base 12 comprises a pair of sidewalls 18, 20 connected by a pair of the bars 22, 24. As best shown in FIG. 3, sidewall 20 is generally triangular having a narrow apex 26 and an enlarged end 28. Sidewall 18 is identical with an apex 25 and an enlarged end 27.

As best shown in FIGS. 2 and 3, the drive means 16 comprises an air cylinder 30 which is mounted on a rod 32. The air cylinder 30 is of the double-ended rod type, which allows the cylinder 30 to travel along the rod 32 while the rod 32 remains fixed. Such a cylinder is available from the Humphrey Company of Kalamazoo, MI. As shown in FIG. 2, the cylinder 30 is attached to a flexible air tube 34. An air pump 36 is connected to the end of the tube 34 opposite the cylinder 30. The air pump 36 comprises a flexible, inflatable rubber bulb 38 and an air pressure meter 40. The meter 40 has a valve 42. A Polmonitor Sphygonomanometer is suitable as such a pump 36.

The rod 32 on which the cylinder 30 moves has a U-shaped bracket 44 disposed adjacent to the apexes 25, 26 of the sidewalls 18, 20. A support 46 is disposed through the apexes 25, 26 of the sidewalls 18, 20 and through the bracket 44 of the rod 32. As shown in FIG. 2, the bracket 44 of the rod 32 is located in the middle of the support 46 about equidistant from the sidewalls 18, 20. Caps 41, 43 prevent the support 46 from slipping out of the sidewalls 18, 20.

Figure 4:
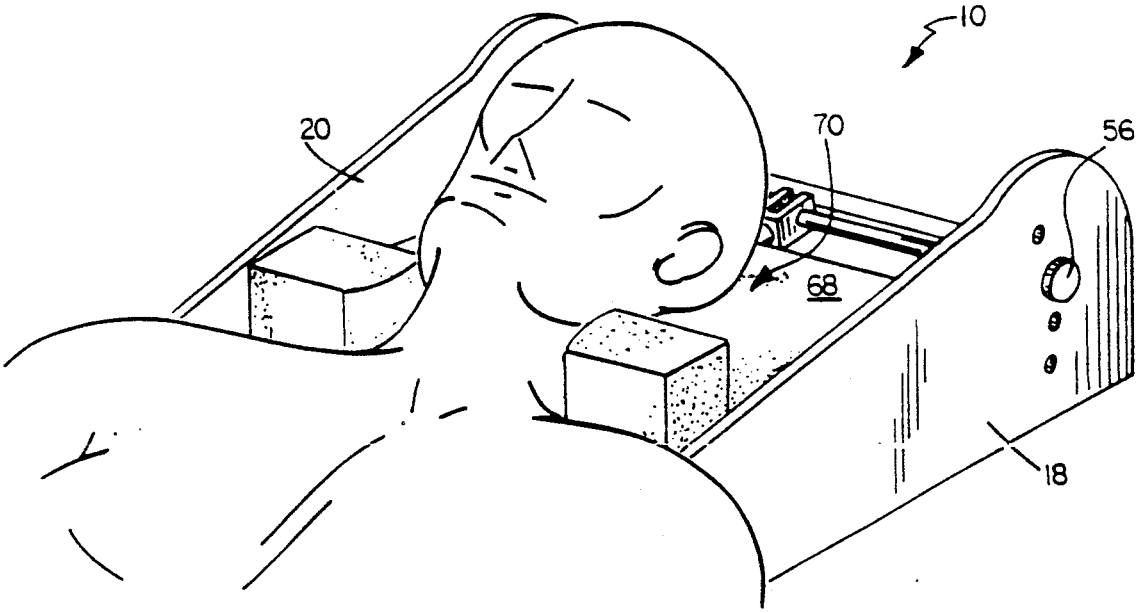
FIG. 4 is a perspective view illustrating a patient utilizing the invention for traction purposes.

The rod 32 has a second bracket 48 which is attached to a second support 47 in a similar manner as with the first bracket 44. However, as shown by FIGS. 1 and 3, the support 47 may be disposed in any one of a series of holes in the enlarged ends 27, 28 of the sidewalls 18, 20. As shown in FIGS. 1 and 4, the support 47 is disposed in the second pair of holes 50. As shown in FIGS. 2 and 3, the support 47 is disposed in the uppermost holes 50. This controls the angle of rod 32 and the cylinder 30. In the preferred embodiment, depending on the pair of holes 50 selected for the support 47, the rod 32 may be disposed parallel to the surface on which the base 12 is placed, or it may be increased by an angle of approximately 30° from that surface. Specifically, the support 47 extends through one set of the holes 50 and a small portion 51 of the support 47 projects outside the sidewalls 18, 20. A removable cap 56 (not shown in FIG. 1) is connected to the portion 51 of the support 47 that projects beyond the sidewall 18. A similar cap 57 is disposed on the opposite side. As the size of the caps 56, 57 is greater than the diameter of the holes 50, the support 47 is held in place. The caps 56, 57 are removed to reposition the support 47 in another set of holes. Finally, as shown in FIG. 3, the cylinder 30 has attached at each end an L-shaped bracket 52, 54. The brackets 52, 54 move on the rod 32 with the cylinder 30.

The head support section 14 comprises a plate 58, the bottom of which is mounted to the brackets 52, 54 attached to the cylinder 30. A neck support 60 is disposed at the end of the plate 58 generally adjacent to the apex portions 25, 26 of the sidewalls 18, 20. The neck support 60 comprises a centrally recessed portion 62 boarded by a pair of raised portions 64, 66. An occipital pad 68 for supporting the back of the head extends from the neck brace 60 to the other end of the plate 58.

As best shown in FIG. 3, the occipital pad 68 is reverse angled with the highest or thickest portion of the pad adjacent to the neck support 60, and the narrowest portion at the opposite end of the plate 58. In the preferred embodiment, the angle between the plate 58 and the plane of the top surface 70 of pad 68 is about 20°, although other angles are possible. The neck support 60 and pad 68 are preferably an air jell surrounded by soft rubber.

In operation, the general tractive angle of the head support means 14 is selected by placing the support 47 through the proper holes 50, and then fastening the support 47 in place by the caps 56, 57. The angle is selected based on the portion of the cervical spine on which traction is desired. The higher angles are for traction on lower portions of the neck, and the lower angles are for focusing traction on the upper neck. The patient then lies down placing his or her neck in the neck support 60 and the back of the head on the occipital pad 68, as is generally shown in FIG. 4.

To apply traction, the patient squeezes the bulb 38 of the air pump 36. This provides air pressure to the cylinder 30. The pressure meter 40 displays the amount of air pressure being provided to the cylinder 30. The air pressure causes the cylinder 30 to move along the rod 32 away from the support 46 and towards support 47.

As indicated by the Figures, this movement of the cylinder 30 with respect to the rod 32 and the base 12 also moves the occipital pad 68 and the neck support 60 creating cervical traction. Specifically, the neck is stretched in the direction of the movement. At the same time, however, the movement of the occipital pad 68 with its reverse angle causes the patient's head to tilt forward somewhat. This increases cervical flexion and further opens the holes in the cervical spine.

Furthermore, the apparatus 10 is comfortable to use, and thus allows the patient to maintain static traction over a longer period of time because there is less pressure on the greater occipital nerve and the occipital artery. The reverse angle of the occipital pad 68 assures that as traction is applied (by moving the cylinder 30) the back of the head remains in contact with the pad 68. This is very important for several reasons. First, in some prior art devices, the back of the head loses contact with the support pad as traction is applied which increases discomfort by causing all pressure at the base of the occiput rather than distributing it between the base and the back of the occiput, as with this invention.

In addition, the cylinder 30, because of its arrangement with respect to the pad 68, provides a direct application of traction to the spine, rather than the indirect one provided by some prior art pulley devices.

The patient also controls the tractive force. The patient applies the air pressure to the cylinder 30 by the bulb 38. By the same token, the patient can monitor the air pressure to the cylinder 30 by the meter 40 and can release the pressure or reduce it by opening the valve 42. A spring (not shown) located within the air cylinder 30 will return the cylinder 30 towards the support 46 and its non-traction position as the air pressure is reduced.

The invention is not limited to the embodiment disclosed here and other variations will be apparent to those skilled in the art.

What I claim is:

1. A cervical traction apparatus comprising:

a base, a head support means, said head support means comprising a neck receiving portion and an occipital pad having a top surface, said occipital pad being of decreasing thickness with the thickest portion of said pad being adjacent to said neck receiving means and being approximately the same height as said neck receiving portion and the thinnest portion of said pad being opposite said neck receiving portion so that said top surface is disposed at an acute angle from the plane of said neck receiving portion, said occipital pad being angled so that the back of the head of the patient and not the head and neck junction is in contact with the pad when in use, and a drive means, said drive means being attached to said head support means and also being connected to said base, wherein when in use said drive means selectively moves said head support means with respect to said base to apply cervical traction to a patient, the back of whose head is disposed on said occipital pad and whose neck is disposed in said neck receiving potion, said pad remaining in contact with the back of the patient's head as traction is applied, as the patient's head slips on said pad thereby avoiding pressure on the greater occipital nerve and artery and at the same time the angle of said pad tilting the patient's head forward providing cervical flexion for the patient.

2. The apparatus of claim 1 wherein said head support means includes a means for adjusting the angle of said head support means with respect to said base so as to isolate the tractive force on a particular section of the cervical spine when in use.

3. The apparatus of claim 2 wherein said means for adjusting comprises an adjustable rod, said adjustable rod having a first end which is fixed to said base and a second end which is attached to said base by a means for raising and lowering, which may be selectively positioned to vary the height of said second end of said rod with respect to said first end.

4. The apparatus of claim 3 wherein said means for raising and lowering comprises a support attached to said rod, said support being selectively connected to one pair of a series of pairs of holes disposed in said base, the selection of one of said pairs of holes determining the angle of said adjustable rod and said head support means with respect to said base.

5. The apparatus of claim 1 wherein said neck receiving portion comprises a pair of neck pads bounding a recessed portion.

6. The apparatus of claim 1 wherein said occipital pad has a generally triangular cross-section.

7. The apparatus of claim 1 wherein said drive means comprises a rod connected to said base, an air cylinder being movably disposed on said rod, said air cylinder being fixed to said head support means, said air cylinder moving on said rod when air pressure is applied to it by an air pressure means, the movement of said air cylinder on said rod also moving said head support means with respect to said base.

8. The apparatus of claim 1 wherein said air pressure means comprises an air pressure bulb and a valve, said bulb being connected to said air cylinder by a tube, said bulb being operated by the patient when said apparatus is in use to apply air pressure to said air cylinder.

* * * * *